United States Patent [19]

Okkerse

[11] Patent Number: 4,682,429

[45] Date of Patent: Jul. 28, 1987

[54] TROUSERS-PRESS

[76] Inventor: Cornelis E. G. Okkerse, Hoornbruglaan 36, Rijswijk, Netherlands

[21] Appl. No.: 815,009

[22] Filed: Dec. 31, 1985

[30] Foreign Application Priority Data

Jan. 3, 1985 [NL] Netherlands ..... 8500012

[51] Int. Cl.[4] ..... D06F 71/12

[52] U.S. Cl. ..... 38/36; 16/379

[58] Field of Search ..... 38/DIG. 1, DIG. 2, 36, 38/71, 1 C; 223/73; 16/251, 250, 378, 379; 100/233, 236; 248/397; 211/195, 198; 312/120; 40/611, 13

[56] References Cited

U.S. PATENT DOCUMENTS 1,470,376 10/1973 Chambers ..... 38/71
3,145,490 8/1964 Corby .
3,477,154 11/1969 Corby ..... 38/71
3,491,469 1/1970 Niehenke .
4,514,918 5/1985 Warner ..... 38/36

FOREIGN PATENT DOCUMENTS 1161841 9/1958 France .
2215072 10/1974 France ..... 38/71

*Primary Examiner*—Werner H. Schroeder
*Assistant Examiner*—Andrew M. Falik
*Attorney, Agent, or Firm*—Schwartz, Jeffery, Schwaab, Mack, Blumenthal & Evans

[57] ABSTRACT

A trouser press comprising an upright press plate, a press plate pivotally movable with respect thereto, and a clamping means for attaching one press plate to the other press plate. The press plates are mounted in a support frame, which frame comprises free spaces for the mounting of the clamping means, as well as two mutually spaced hinge arms. The hinge arms of the frames are coupled in pairs to a hinge support.

6 Claims, 9 Drawing Figures

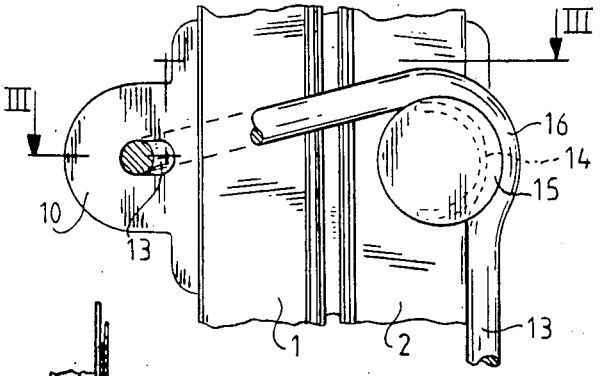
FIG. 2
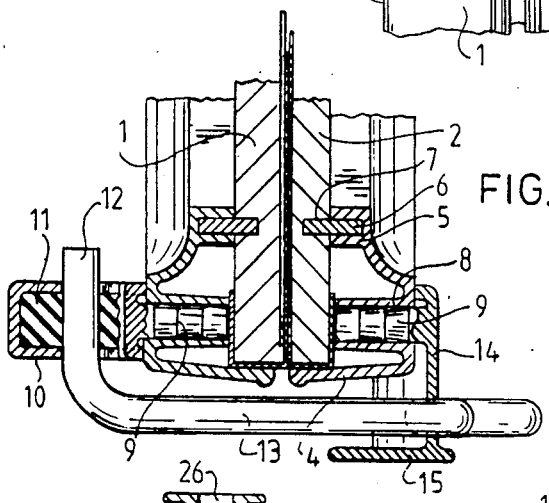
FIG. 3
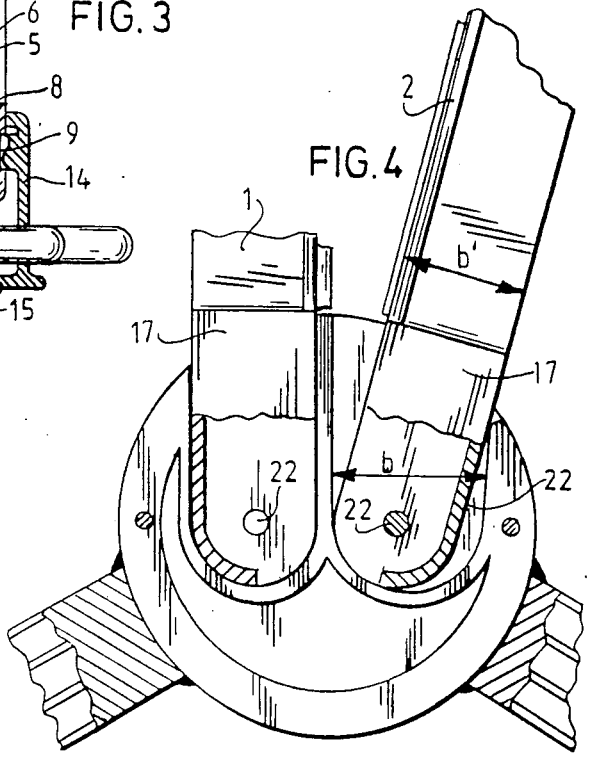
FIG. 4
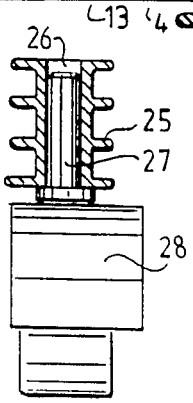
FIG. 6
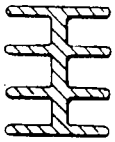
FIG. 7
FIG. 5
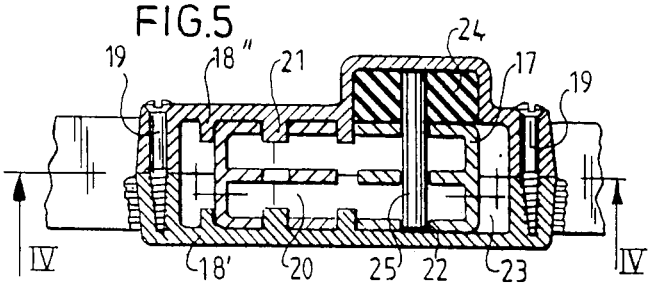

TROUSERS-PRESS

BACKGROUND OF THE INVENTION

1. Field of the Invention

The invention relates to a trouser press comprising an upright press plate, a press plate pivotally movable with respect thereto and a clamping means for attaching one press plate to the other press plate.

2. Description of the Related Art

A conventional trouser press is usually made of wood. The conventional press plates are mutually connected by hinges and are supported by wooden uprights. The various components are usually connected by means of bolts and the like. A trouser press of conventional design requires considerable manual labor to assemble. Such trouser presses are relatively expensive.

SUMMARY OF THE INVENTION

It is therefore an object of the present invention to provide a trouser press which is very simple to put together with minimal manual labor and expertise required.

In accordance with one aspect of the present invention, this object is achieved by a trouser press in which each plate is mounted to a support frame. The frame comprises free space for the mounting of the clamping means, as well as two mutually-spaced hinge arms. The hinge arms of the frames are coupled in pairs to a hinge support.

A support frame is provided for each press plate. The use of a support frame avoids the need for additional tooling of the press plates. Additionally, the support frames are connected by hinges. The frames can be mechanically manufactured in one processing step, for example, according to the injection moulding process. This method of manufacture reduces cost and simplifies mounting.

The hinge support is preferably made in the form of a casing. The casing is provided with a first area in which the hinge arm of one frame is securely mounted, and a second area in which the hinge arm of the other frame is pivotably mounted.

In the preferred embodiment each casing area is made in the form of a sheath. The width of the second area is larger than the width of the pivotally mounted hinge arm. The second area is wider than the thickness of the pivotally mounted hinge arm, and thereby suitable for receiving a flexible material, into which extends a hinge pin of the securely mounted hinge arm. Trousers of various thickness can easily be brought between the press plates, while the press plates still remain parallel to each other.

In order to facilitate the mounting of the hinge arms, it is preferable to construct a hinge casing that can be divided into opposing sections which are transverse to the direction of the hinge pin. Additionally, part of the hinge casing forms an integral part of the foot part.

According to one aspect of the invention, one of the plates is coated with a foil which contains an electrical resistance body which will provide heat supplied by an electrical current. The simple mounting of an electrical resistance body within the foil reduces the cost of the trouser press.

BRIEF DESCRIPTION OF THE DRAWINGS

The invention is described in greater detail below with reference to the accompanying drawings.

In the drawings:

FIG. 2 shows a view in detail in the direction of arrow II in FIG. 1;

FIG. 3 is a cross-section of the invention in detail along the line III—III in FIG. 2;

FIG. 4 shows a partial view of a vertical cross-section of the hinge casing along the line IV—IV in FIG. 5;

FIG. 5 is a cross-section of the invention along the line V—V in FIG. 1;

FIGS. 6 and 7 each show a cross-section along the lines VI—VI and VII—VII, respectively, in FIG. 1;

DETAILED DESCRIPTION OF PREFERRED EMBODIMENTS

Figure 1:
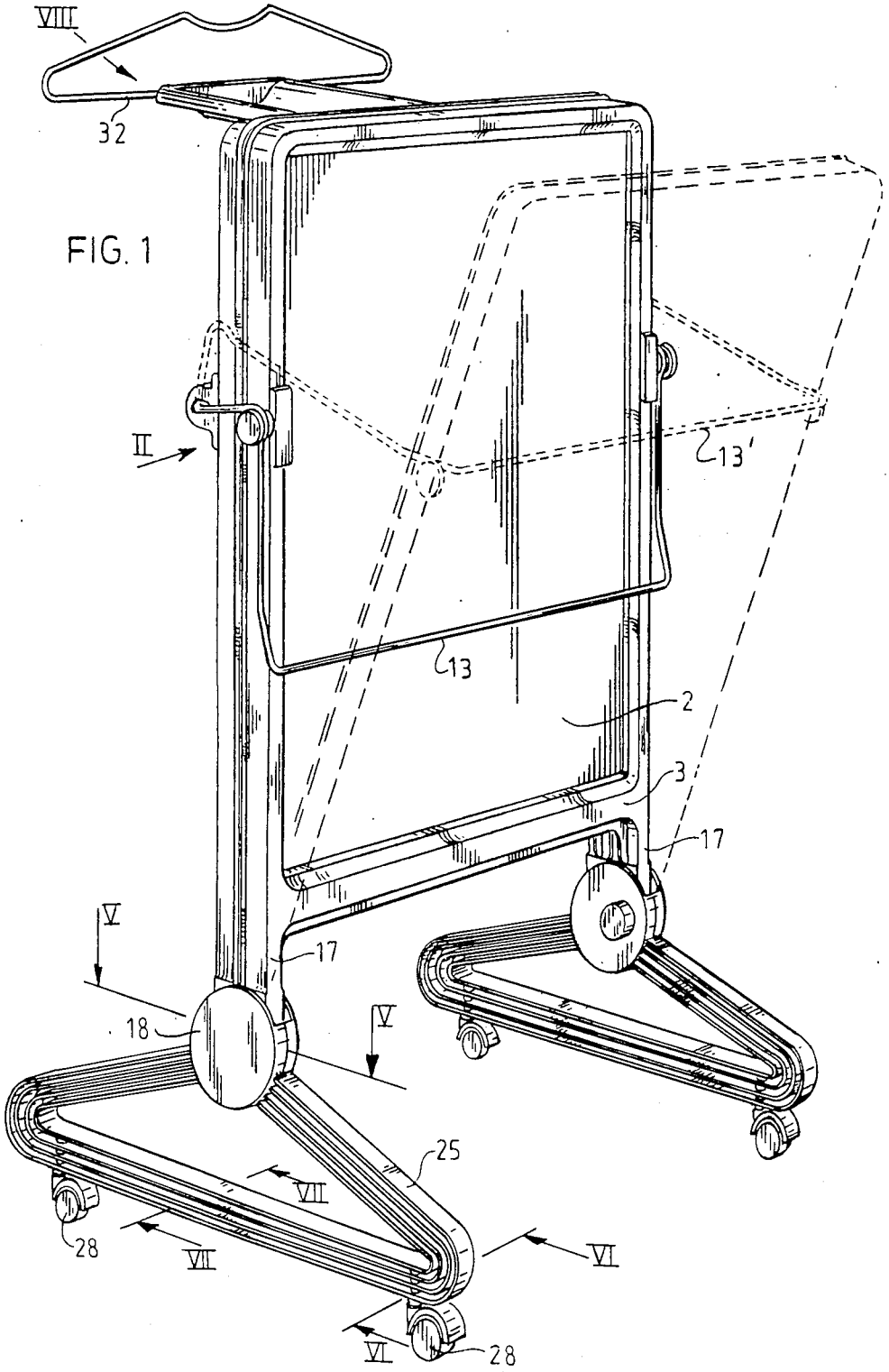
FIG. 1 shows a perspective view of the trouser press according to the invention.
Figure 9:
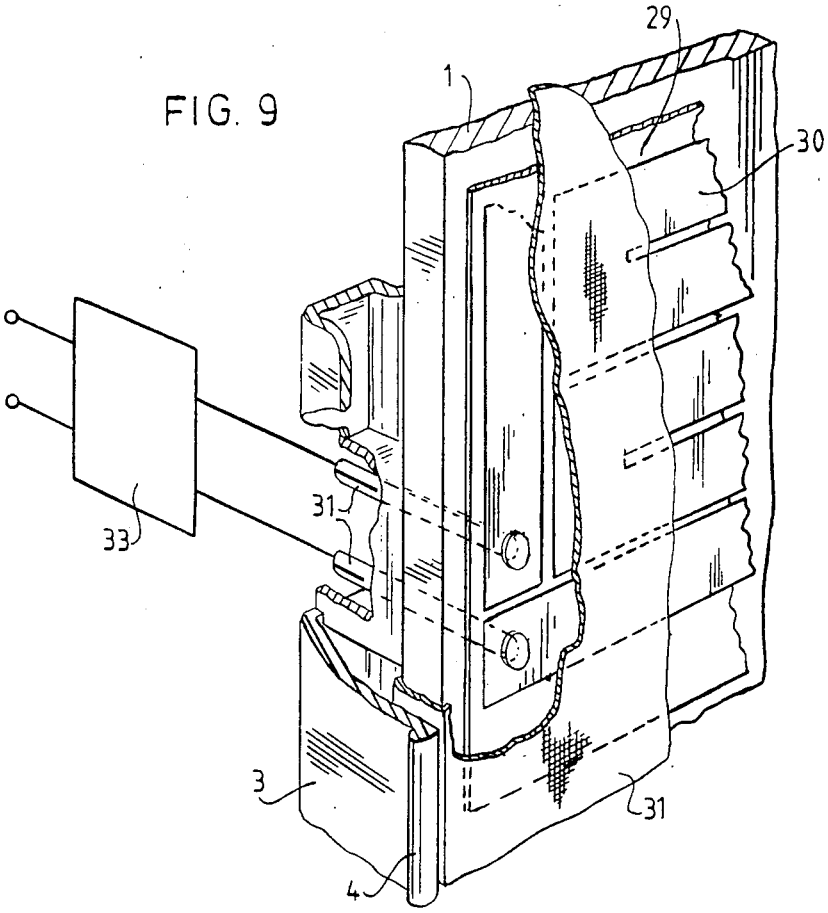
FIG. 9 is a perspective view of the one press plate provided with a heating foil.

In the figures the press plates are indicated with the numbers 1 and 2, respectively. The plates may be made from anyone of a variety of materials, for example, wood.

According to the invention each plate is mounted in a frame 3, identical frames are provided for both plates.

According to FIG. 3 the frame in cross section has a substantially U-shaped form, whereby one of the legs 4 is longer than the other leg 5. The other leg 5 moreover has a cylindrical shape for accepting a spring 6, which fits into a groove 7 of the press plates 1 and 2, respectively. The long leg 4 of the frame profile fits tightly to the outer rim of each press plate 1. This provides a solid fitting of the plates into the frames.

The frame is provided with free spaces 8 in which the pins 9 can be clamped. Additionally, the clamping means for clamping together of the press plates 1 and 2, respectively, are fit into free spaces 8.

According to FIGS. 1 and 3 the press plate clamping means consist of a bearing casing 10, provided with at least two pins 9, which extend into the matching free spaces 8 of the frame 3. The bearing casing 10 is provided with a flexible filling 11 of, for example, rubber, wherein extends a curved extreme part 12 of a bow-shaped grip 13. The curved extreme part 12 thereby extends into a slot-shaped opening of the bearing casing 10.

The frame of the pivoting plate 2 is made in a manner similar to that of the stationary plate frame in which a support casing 14 holds a knob 15, around which a bent corner 16 of the handle 13 engages.

Upon closing of the plates, the strap-shaped handle 13 can be flapped down from a position indicated by the broken line 13' in FIG. 1, to a position indicated by the full line 13 in FIG. 1, so that the bent part 16 snaps around the knob 15. A flexible spring action is caused by the body 11 in the bearing casing 10, which preloads the pin-shaped end of the extreme part 12 towards the left in FIG. 3, so that the plates 1 and 2 are clamped together. Space is provided which can accommodate either a thick or thin garment, respectively.

Each frame 3 is made with a pair of hinge arms 17, which are located mutually spaced apart and which extend into a casing-like hinge support 18. According to FIGS. 4 and 5, the casing-like support consists of a first circular bowl part 18', onto which a second identically shaped circular bowl lid 18" may be mounted by means of bolts 19. With the bowl parts placed on top of each other, the casing has a first area 20, into which the hinge arm 17 of the fixed, first press plate 1 is fittingly accepted. The area is such, that a secure connection is made between the hinge arm 17 and the casing 18, whereby the bowl parts are each provided with a cam 21 at the inner side thereof, which extend into a free space 22 of the hinge arm.

The casing is further provided with a second area 23, the width b of which is larger than the width b' of the hinge arm 17 of the other press plate 2. Moreover, the inner width of the area 23 is larger than the thickness of the hinge arm 17. In this manner the area 22 is suitable for a flexible body 24. A hinge pin 25 inserts in the area 22 of the hinge arm 17, which extends into the flexible body 24.

The construction described above provides the hinge arm 17 of the frame 3 of the press plate 2 with a freedom of movement in the area 23, which in turn allows the press plate 2 to turn outwards. This outward movement is away from the press plate 1, up to a position as shown in FIG. 4. In this position it is possible to introduce the garment over the pivoting plate 2 in a known manner and to turn the plate 2 back subsequently and to fixedly clamp the plate by means of the handles 13 as described hereinabove.

For a thin or thick garment, it is possible that the press plate 2 enjoys a freedom of movement with respect to press plate 1 owing to the application of the flexible body 24 of the casing 18. The flexible body 24 also provides a specific preload.

The bowl-shaped casing part 18' forms an integral part with the foot part 35, the cross section of which is shown in FIGS. 6 and 7. The foot part 35 has a free space 26 at the level of the cross section according to FIG. 6 for receiving a pin 27 of a rotatable wheel 28.

From the above description of the figures, it will be obvious that mounting of the trouser press according to the invention can take place in a particularly simple manner.

The press plates 1 and 2 are only placed into the frames 3 by means of the groove and tongue connection of spring and groove 6 and 7, respectively. The press plates are mounted solely by clamping action.

The clamping means 9–16 may also be attached to the frame 3 by inserting and clamping of the relevant elements. The hinge arms 17 are placed into the bowl part 18' of each foot part 35, whereupon the lid part 18" of the hinge casing can be bolted by means of the bolts 19 located on the inside of the casing. The remaining auxiliary parts, such as swivel wheels and the like, are positioned in a similar manner by means of clamping with a pin-hole connection.

It is observed that the cost may also be lowered by providing the press plate 1 with a foil 29, which is provided with a resistance wire 30. This resistance wire can also be connected with contact pins 31 at the side of the plate 1 facing away from the press side, onto which a plug for the feeding voltage can be fitted. The foil 29, into which the heating wire 30 is incorporated, can be stapled or glued onto plate 1. The plates 1 and 2 are both provided with a textile layer 34, which extends over the outer rim and can be clamped within the longer leg 4 of the frame 3.

Figure 8:
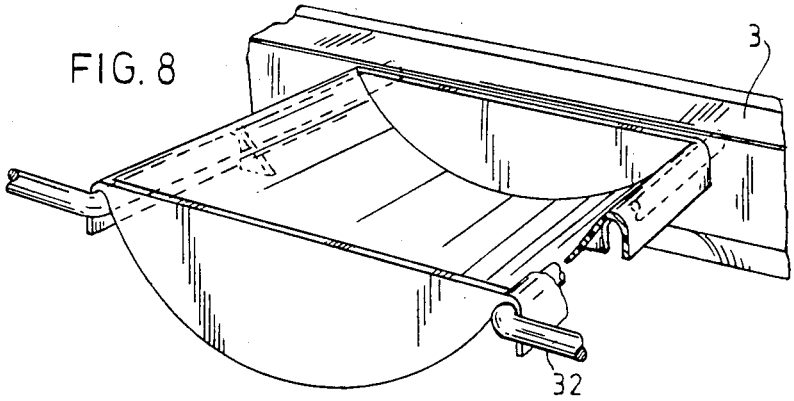
FIG. 8 is a top view in perspective of a coat hanger, connected with the press, in the direction of arrow VIII in FIG. 1.

Finally, FIG. 8 shows the possibility of mounting a coat hanger 32 onto the profile of the frame 3.

The invention is not limited to the embodiment described above. The hinge casing 18 may be designed in a different manner.

I claim:

1. A trouser press comprising:

(a) a substantially upright first press plate;

(b) a second press plate pivotally movable relative to said first press plate;

(c) means for clamping said press plate together;

(d) a plurality of support frames comprising upright sides and transverse top and bottom portions;

(e) each of said press plates being mounted within one of each said support frames;

(f) a pair of frame hinge arms extending below said bottom transverse portion and forming a continuation of said upright portions;

(g) said frame hinge arms being coupled to a hinge support which is in the shape of a casing, said casing being provided with a first space for receiving a hinge arm of the one frame, and a second space for pivotally receiving the hinge arm of the other frame.

2. The press according to claim 1, wherein said first and second spaces are made as a sheath, said second space having a width (b) which is larger than the width (b') of said hinge arm placed therein.

3. The press according to claim 2, wherein said second space is wider than the thickness of said hinge arm extending therein, said second space being suitable for receiving a flexible body into which a hinge pin of the arm of the other plate extends.

4. The press according to claim 1, wherein a part of said casing forms an integral part of a foot part.

5. The press according to claim 1, wherein said frame of said first plate is similar to the frame of said second plate.

6. The press according to claim 1, wherein one of said plates is covered at the press side with a foil which is provided with an electrical resistance body.

* * * * *